US008475195B2

(12) United States Patent
Annis et al.

(10) Patent No.: US 8,475,195 B2
(45) Date of Patent: Jul. 2, 2013

(54) LATCH FOR A CARD EDGE CONNECTOR SYSTEM

(75) Inventors: Kyle Gary Annis, Hummelstown, PA (US); Robert Neil Whiteman, Jr., Middletown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 50 days.

(21) Appl. No.: 13/196,496

(22) Filed: Aug. 2, 2011

(65) Prior Publication Data

US 2013/0034984 A1 Feb. 7, 2013

(51) Int. Cl.
*H01R 13/62* (2006.01)

(52) U.S. Cl.
USPC ..... 439/328; 439/160

(58) Field of Classification Search
USPC ..... 439/152, 157, 160, 325–328, 377
See application file for complete search history.

(56) References Cited

U.S. PATENT DOCUMENTS 5,470,240 A * 11/1995 Suzuki ..... 439/157
5,647,755 A * 7/1997 Hida et al. ..... 439/328
5,980,299 A 11/1999 Davis
6,045,385 A 4/2000 Kane
6,083,026 A 7/2000 Trout et al.
6,160,706 A 12/2000 Davis et al.
6,168,450 B1 1/2001 Davis et al.
7,029,307 B1 * 4/2006 Ling et al. ..... 439/327
7,118,398 B2 * 10/2006 Leidy ..... 439/160
7,134,896 B1 * 11/2006 Chen ..... 439/326
7,294,009 B1 * 11/2007 Peng et al. ..... 439/326
7,470,136 B2 * 12/2008 Yahiro et al. ..... 439/326
7,682,179 B1 * 3/2010 Tsai ..... 439/326
8,052,448 B2 * 11/2011 McKee ..... 439/326

* cited by examiner

*Primary Examiner* — Thanh Tam Le

(57) ABSTRACT

A latch for securing a circuit card assembly to a circuit board mounted card edge connector includes first and second arms disposed on opposite ends of the card edge connector. The first and second arms define a reception space that receives the circuit card assembly. The first arm has a deflectable spring latch that is movable between a released position and a latched position. The circuit card assembly is secured by the spring latch in the latched position. The second arm has a latch hook that is configured to hook around and engage a portion of the circuit card assembly during mating of the circuit card assembly and the card edge connector. The latch hook defines a pivot point for pivoting the circuit card assembly into the card edge connector during mating of the circuit card assembly and the card edge connector.

19 Claims, 5 Drawing Sheets

LATCH FOR A CARD EDGE CONNECTOR SYSTEM

BACKGROUND OF THE INVENTION

The subject matter herein relates generally to latches for card edge connector systems.

In computers and other electronic equipment, circuit boards are utilized to which are mounted numerous electrical and electronic components. Smaller circuit cards are utilized to establish electrical connections to a larger circuit board in a manner that permits removal and disconnection, by inserting an edge of the card into a card edge connector mounted on the circuit board. The card edge connector includes an array of contacts connected to circuits of the circuit board. Contact sections of the contacts are exposed within a card receiving slot of the card edge connector to engage circuit pads on the circuit cards when the circuit cards are inserted into the card edge connectors. It is known to provide elongate retention members projecting from the board proximate to ends of the card edge connectors to facilitate guiding and mating of the circuit cards to the card edge connectors. The retention member typically extends along the entire ends of the circuit card and guides loading of the circuit card in a vertical direction directly into the slot of the card edge connector.

Known systems that use elongate retention members are not without disadvantages. For example, the retention members may interfere with electronic components mounted to the circuit cards. For example, some circuit cards have optical connectors mounted thereto. The optical connectors have optical fibers extending therefrom. The retention members tend to interfere with the optical fibers as the optical fibers exit the circuit card. The optical fibers may need to be bent around the retention members, which is undesirable. Additionally, loading the circuit cards into the card edge connectors may be difficult and require a high insertion force, particularly when a high number of contacts and contact pads are provided on the card edge connector and circuit card. Loading the circuit cards straight into the card edge connectors requires all of the contacts and contact pads to be mated simultaneously, which increases the insertion force.

It is desired to assure that all tolerance is eliminated between the circuit card and the card edge connector to eliminate looseness from the resulting mated assembly and to stabilize the circuit card against the effects of vibration and other movement. It is also desired to provide a more convenient manner of securing the circuit card to the card edge connector.

BRIEF DESCRIPTION OF THE INVENTION

In one embodiment, a latch is provided for securing a circuit card assembly to a circuit board mounted card edge connector. The latch has first and second arms disposed on opposite ends of the card edge connector. The first and second arms define a reception space that receives the circuit card assembly. The first arm has a deflectable spring latch that is movable between a released position and a latched position. The circuit card assembly is secured by the spring latch in the latched position. The second arm has a latch hook that is configured to hook around and engage a portion of the circuit card assembly during mating of the circuit card assembly and the card edge connector. The latch hook defines a pivot point for pivoting the circuit card assembly into the card edge connector during mating of the circuit card assembly and the card edge connector.

In another embodiment, a card edge connector system is provided having a card edge connector that has a housing. A plurality of contacts are held by the housing and a slot in the housing is configured to receive a circuit card assembly therein for mating with the contacts. The card edge connector is configured to be coupled to a main circuit board. A latch cooperates with the card edge connector to secure the circuit card assembly in the card edge connector. The latch is configured to be coupled to the main circuit board. The latch includes a first arm and a second arm. The first arm has a deflectable spring latch configured to engage a portion of the circuit card assembly during mating of the circuit card assembly and the card edge connector. The second arm has a latch hook configured to hook around and engage a portion of the circuit card assembly during mating of the circuit card assembly and the card edge connector. The latch hook defines a pivot point for pivoting the circuit card assembly into the card edge connector during mating of the circuit card assembly and the card edge connector.

In a further embodiment, a card edge connector system is provided having a circuit card assembly that has circuit card having a plurality of conductors. The circuit card has a plug edge. The circuit card has a first end and a second end opposite the first end. The card edge connector system also includes a card edge connector having a housing. A plurality of contacts are held by the housing and a slot is formed in the housing. The slot receives the plug edge of the circuit card therein for mating the conductors with the contacts. The card edge connector is configured to be coupled to a main circuit board. A latch cooperates with the card edge connector to secure the circuit card assembly in the card edge connector. The latch is configured to be coupled to the main circuit board. The latch includes a first arm and a second arm. The first arm has a deflectable spring latch that engages the first end of the circuit card during mating of the circuit card assembly and the card edge connector. The second arm has a latch hook that hooks around and engages the second end of the circuit card during mating of the circuit card assembly and the card edge connector. The latch hook defines a pivot point for pivoting the circuit card assembly into the card edge connector during mating of the circuit card assembly and the card edge connector.

DETAILED DESCRIPTION OF THE INVENTION

Figure 1:
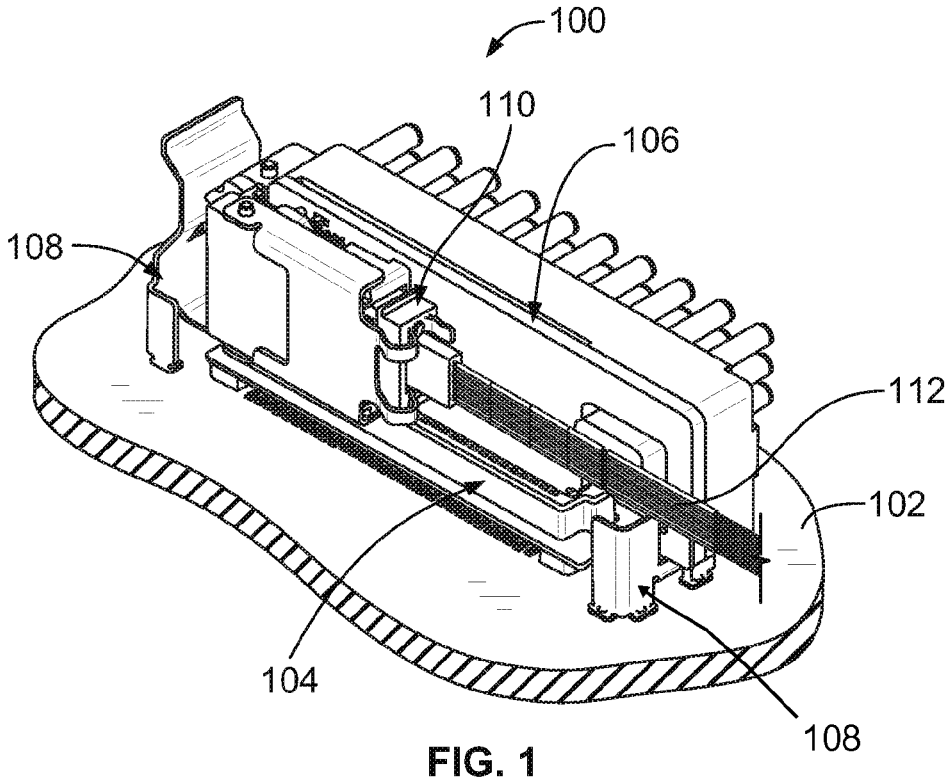
FIG. 1 illustrates a card edge connector system formed in accordance with an exemplary embodiment.

FIG. 1 illustrates a card edge connector system 100 formed in accordance with an exemplary embodiment. The card edge connector system 100 is mechanically and electrically connected to a main circuit board 102. The card edge connector system 100 includes a card edge connector 104 mounted to the main circuit board 102. A circuit card assembly 106 is mated to the card edge connector 104. A latch 108 cooperates with the card edge connector 104 to secure the circuit card assembly 106 in the card edge connector 104.

The latch 108 engages the circuit card assembly 106 to hold the circuit card assembly 106 in the card edge connector 104. The latch 108 resists shock and vibration to hold the circuit card assembly 106 in the card edge connector 104. In an exemplary embodiment, the latch 108 is configured to help mate the circuit card assembly 106 to the card edge connector 104. For example, a portion of the circuit card assembly 106 may be coupled to the latch 108 and used as a pivot point during loading of the circuit card assembly 106 into the card edge connector 104.

The latch 108 is provided on both sides of the card edge connector 104. The latch 108 has a low profile so as to not interfere with electrical components of the circuit card assembly 106. For example, in an exemplary embodiment, an optical connector 110 is coupled to the circuit card assembly 106. An optical fiber 112 of the optical connector 110 extends from the circuit card assembly 106. The optical fiber 112 passes over the latch 108. The latch 108 does not interfere with the optical fiber 112. The optical fiber 112 does not have to bend around or be routed around the latch 108, but rather extends along a straight path from the optical connector 110 away from the circuit card assembly 106.

Figure 2:
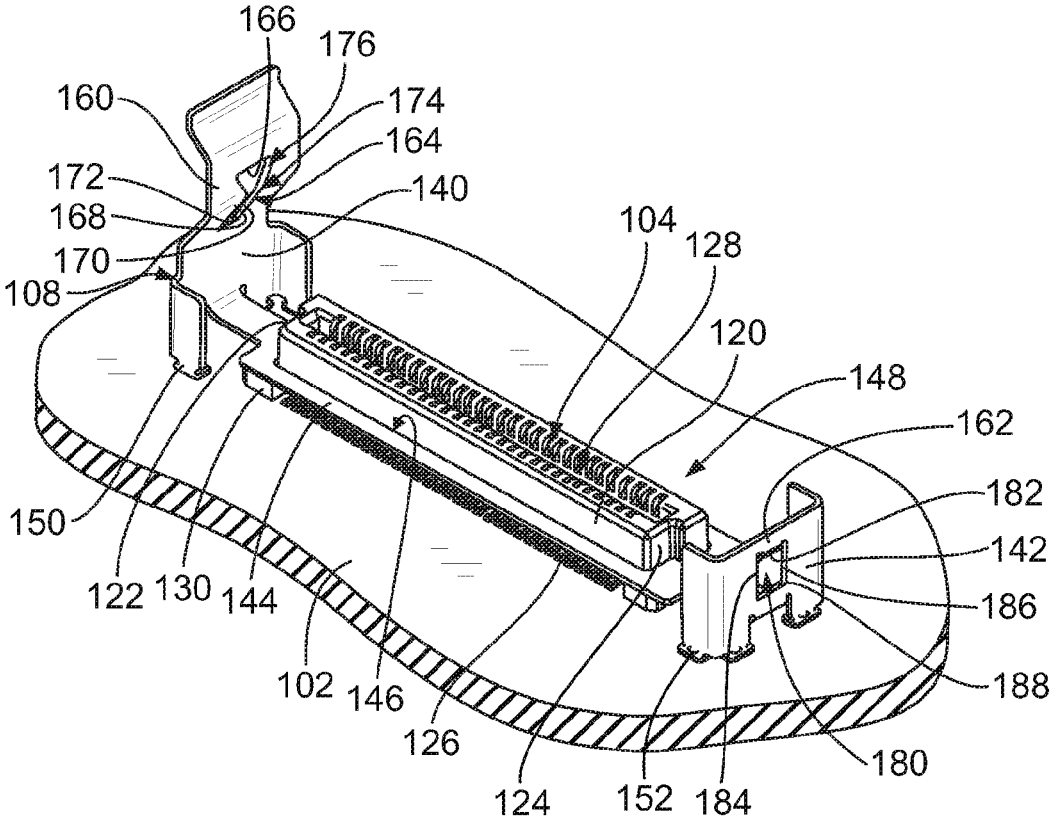
FIG. 2 is an isometric view of a card edge connector and latch of the card edge connector system shown in FIG. 1.

FIG. 2 is an isometric view of the card edge connector 104 and latch 108 mounted to the main circuit board 102. The circuit card assembly 106 (shown in FIG. 1) is not illustrated in FIG. 2. The card edge connector 104 includes a housing 120 extending between a first end 122 and a second end 124. The housing 120 holds a plurality of contacts 126 that are electrically connected to the main circuit board 102. In an exemplary embodiment, the contacts 126 are surface mounted to the main circuit board 102, such as using solder. In an alternative embodiment, the contacts 126 may be mounted to the main circuit board 102 by alternative means. For example, the contacts 126 may include compliant pins that are mounted to the main circuit board 102.

The housing 120 includes a longitudinal slot 128 extending between the first and second ends 122, 124. The contacts 126 are exposed within the slot 128. The slot 128 is configured to receive a card edge of the circuit card assembly 106. The housing 120 includes a base 130 mounted to the main circuit board 102. In an exemplary embodiment, the base 130 may be coplanar with the mounting ends of the contacts 126 such that the base 130 and contacts 126 may be mounted to the main circuit board 102.

The latch 108 includes first and second arms 140, 142 disposed on opposite ends 122, 124, respectively, of the housing 120 of the card edge connector 104. The first arm 140 is configured to secure one end of the circuit card assembly 106, while the second arm 142 is configured to secure an opposite end of the circuit card assembly 106.

The latch 108 includes a base 144 extending between the first and second arms 140, 142. The base 144 has an opening 146 that receives the housing 120 of the card edge connector 104. In an exemplary embodiment, the base 144 extends over and engages the base 130 of the housing 120. When the latch 108 is mounted to the main circuit board 102 the base 144 holds the housing 120 against the main circuit board 102. The latch 108 helps holds the card edge connector 104 to the main circuit board 102, such as to resist shock and vibration. Optionally, the housing 120 and the opening 146 in the base 144 may be keyed to orient the latch 108 with respect to the housing 120. Optionally, the opening 146 may be sized slightly larger than the housing 120, such that the housing 120 may float within the opening 146. In an exemplary embodiment, during assembly, the card edge connector 104 is soldered to the main circuit board 102. During the reflow solder process, the housing 120 may shift or move with respect to the main circuit board 102 to properly position the card edge connector 104 with respect to the main circuit board 102. Having the opening 146 slightly larger than the housing 120 allows the housing 120 to float during the reflow soldering process.

A reception space 148 is defined between the first arm 140 and the second arm 142. The reception space 148 receives the circuit card assembly 106. The reception space 148 is positioned above the base 144.

The first and second arms 140, 142 include mounting elements 150, 152, respectively. The mounting elements 150, 152 are used to mechanically and/or electrically connect the latch 108 to the main circuit board 102. In the illustrated embodiment, the mounting elements 150, 152 are compliant pins extending downward from the first and second arms 140, 142 into the main circuit board 102. Other types of mounting elements may be used in alternative embodiments, such as fasteners, clips, solder tabs or other features to secure the latch 108 to the main circuit board 102. In other alternative embodiments, rather than securing the latch 108 to the main circuit board 102, the latch 108 may be secured directly to the card edge connector 104. Optionally, the latch 108 may be integral with the card edge connector 104. The latch 108 may be secured to another component, such as a heat sink.

The first arm 140 includes a spring latch 160 that defines a securing element of the first arm 140. The spring latch 160 is used to secure the circuit card assembly 106 to the card edge connector 104. The second arm 142 includes a latch hook 162 that defines a securing element of the second arm 142. The latch hook 162 may define a spring latch that is deflectable to secure the card edge connector 104. The latch hook 162 is used to secure the circuit card assembly 106 to the card edge connector 104. The spring latch 160 is configured to secure one end of the circuit card assembly 106, while the latch hook 162 is configured to secure an opposite end of the circuit card assembly 106. The spring latch 160 is deflectable and is configured to move between a released position and a latched position. In the latched position, the spring latch 160 secures the circuit card assembly 106 in the card edge connector 104. In the unlatched or released position, the circuit card assembly 106 may be removed from the card edge connector 104. In an exemplary embodiment, the spring latch 160 is moved from the latched position, away from the second arm 142, to the released position. The spring latch 160 includes a portion that is curved inward into the reception space 148. In an alternative embodiment, rather than having a concave portion, the spring latch 160 may be generally planar, extending generally perpendicular with respect to the main circuit board 102, or may include a convex portion.

The spring latch 160 includes an opening 164 extending therethrough. The opening 164 is defined by an upper wall 166, opposite side walls 168, 170 and a lower wall 172 opposite the upper wall 166. A retention slot 174 is defined between the side walls 168, 170. In an exemplary embodiment, the retention slot 174 is the lower portion of the opening 164. A dovetail 176 is provided above the retention slot 174. The opening 164 is defined by the retention slot 174 and the dovetail 176. The dovetail 176 leads into the retention slot 174 to guide the circuit card assembly 106 into the retention slot 174. In an exemplary embodiment, the side walls 168, 170 are parallel to one another in the retention slot 174 and the side walls 168, 170 are angled with respect to one another in the dovetail 176. The opening 164 is wider in the dovetail 176 than in the retention slot 174. The spring latch 160 restricts movement of the circuit card assembly 106 in multiple directions, such as an unmating direction and side-to-side directions, which may be substantially perpendicular to the unmating direction.

The latch hook 162 includes an opening 180 extending therethrough. The opening 180 is configured to receive a portion of the circuit card assembly 106 during mating of the circuit card assembly 106 to the card edge connector 104. The opening 180 is defined by an upper wall 182, side walls 184, 186 and a lower wall 188. In the illustrated embodiment, the opening 180 is generally rectangular in shape, however the opening 180 may have other shapes in alternative embodiments. In an exemplary embodiment, the latch hook 162 includes a tab 190 (shown in phantom in FIG. 5) extending inward from the upper wall 182 of the opening 180. The tab 190 is configured to engage a portion of the circuit card assembly 106. The tab 190 may define a spring finger that is configured to be spring biased against the circuit card assembly 106 to hold the circuit card assembly 106 in the slot 128 of the housing 120. The tab 190 may provide a downward force against the circuit card assembly 106 to hold the circuit card assembly 106 in the slot 128. The opening 180 and tab 190 help hold the circuit card assembly 106 during shock and vibration. The latch hook 162 restricts movement of the circuit card assembly 106 in multiple directions, such as an unmating direction and side-to-side directions, which may be substantially perpendicular to the unmating direction.

Figure 3:
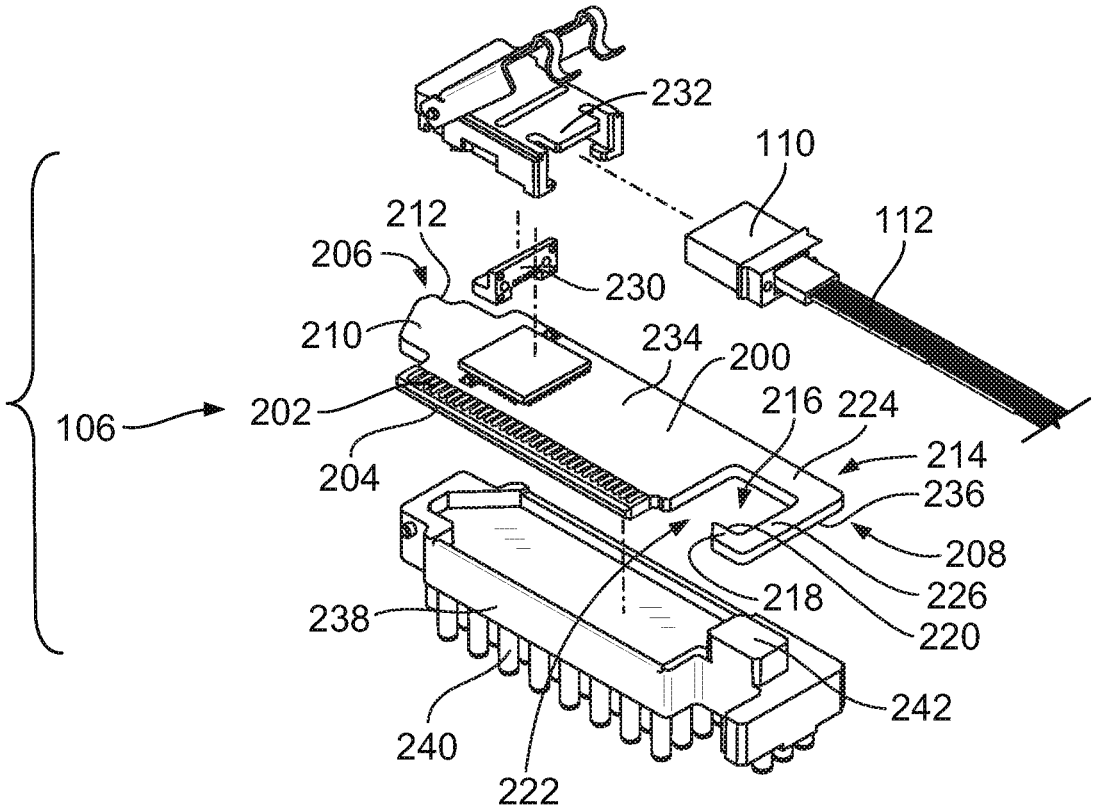
FIG. 3 is an exploded view of the circuit card assembly of the card edge connector system shown in FIG. 1.
Figure 4:
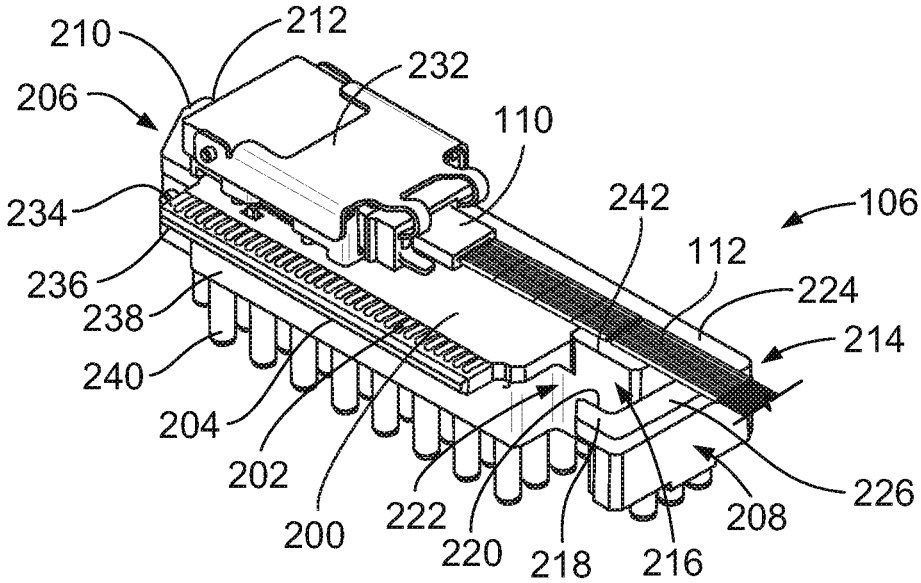
FIG. 4 is an assembled view of the circuit card assembly.

FIG. 3 is an exploded view of the circuit card assembly 106. FIG. 4 is an assembled view of the circuit card assembly 106. The circuit card assembly 106 includes a circuit card 200 having a plurality of conductors 202. The conductors 202 include contact pads and/or traces on the circuit card 200. The circuit card 200 includes a plug edge 204 that is configured to be plugged into the card edge connector 104 (shown in FIG. 1). The circuit card 200 includes a first end 206 and a second end 208 opposite the first end 206.

In an exemplary embodiment, the first end 206 includes a tab 210 extending therefrom. The tab 210 includes an upper surface 212. The upper surface 212 is configured to engage the latch 108 (shown in FIG. 1) to secure the circuit card assembly 106 in the card edge connector 104.

In an exemplary embodiment, the second end 208 includes a hook portion 214. The hook portion 214 extends around a receiving space 216. A hook end 218 is provided at the distal end of the hook portion 214. The hook end 218 has an upper surface 220. In the illustrated embodiment, the upper surface 220 faces the receiving space 216. An opening 222 is provided between the hook end 218 and the main body of the circuit card 200. The opening 222 provides access to the receiving space 216. The hook portion 214 includes an upper arm 224 and an outer arm 226 extending from the upper arm 224. The hook end 218 extends from the outer arm 226 generally opposite the upper arm 224. The receiving space 216 is defined by the main body of the circuit card 200, the upper arm 224, the outer arm 226 and the hook end 218. In an exemplary embodiment, the hook end 218 is provided proximate to a bottom of the circuit card 200. The hook end 218 is generally aligned with the conductors 202 at the plug edge 204.

The circuit card assembly 106 includes one or more electrical components, such as the optical connector 110 that is connected to the circuit card 200. The optical connector 110 is connected to the circuit card 200 using a lens 230. A holder 232 extends over the lens 230 and receives the optical connector 110. The optical connector 110 and lens 230 are provided along a first side 234 of the circuit card 200. A second side 236 of the circuit card 200 is configured to be coupled to a heat sink 238. The heat sink 238 dissipates heat from the circuit card 200 and the components on the circuit card 200. The heat sink 238 includes a plurality of fins 240 extending therefrom for dissipating heat therefrom. In an exemplary embodiment, the heat sink 238 includes a protrusion 242 extending therefrom. The protrusion 242 is received in the receiving space 216. Optionally, the protrusion 242 may support the optical fiber 112. The protrusion 242 may be used to locate the circuit card 200 on the heat sink 238.

Figure 5:
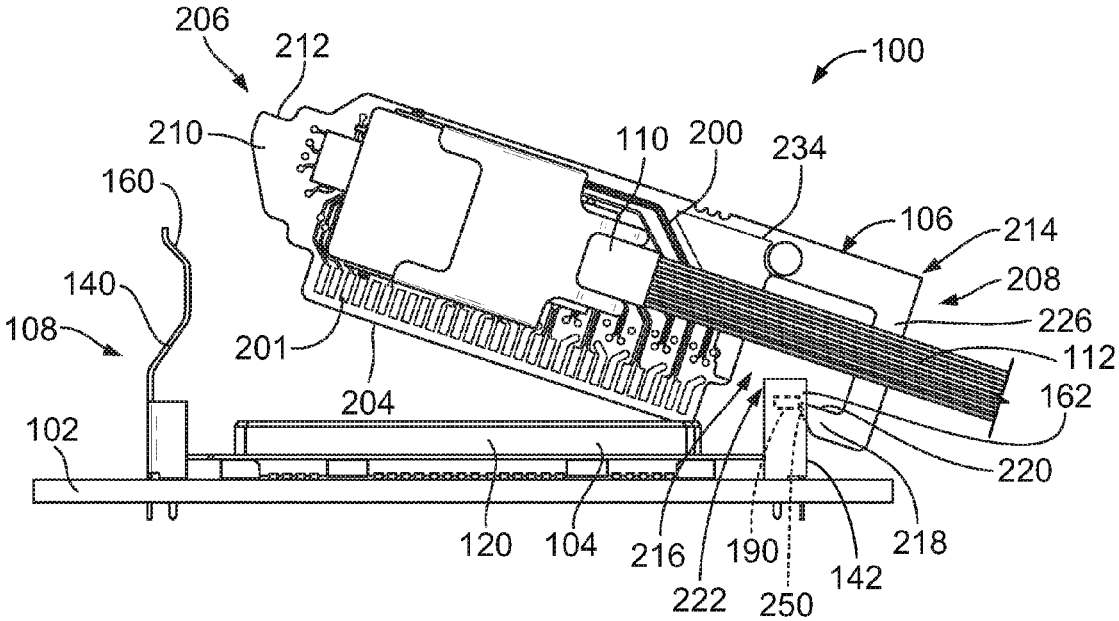
FIG. 5 is a side view of the card edge connector system showing the circuit card assembly positioned for mating with the card edge connector.
Figure 6:
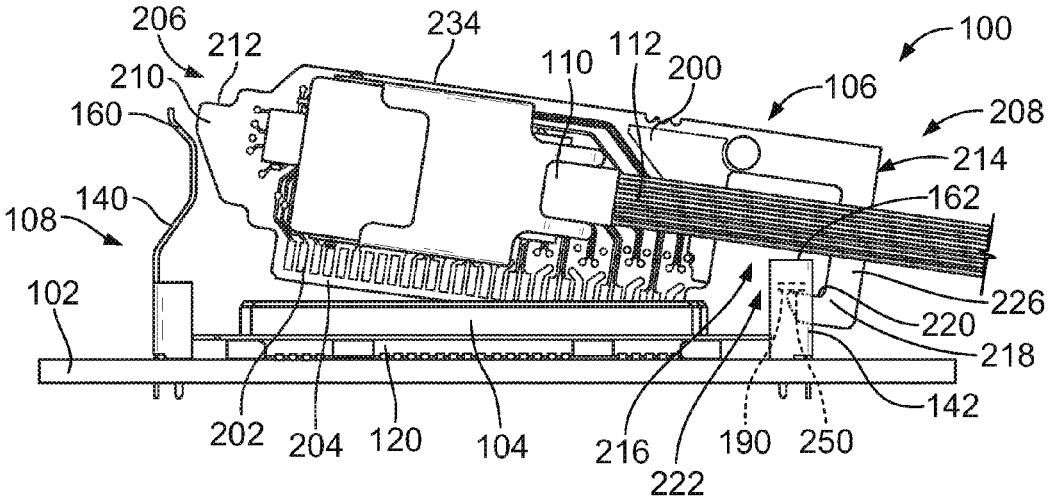
FIG. 6 is a side view of the card edge connector showing the circuit card assembly partially mated with the card edge connector.
Figure 7:
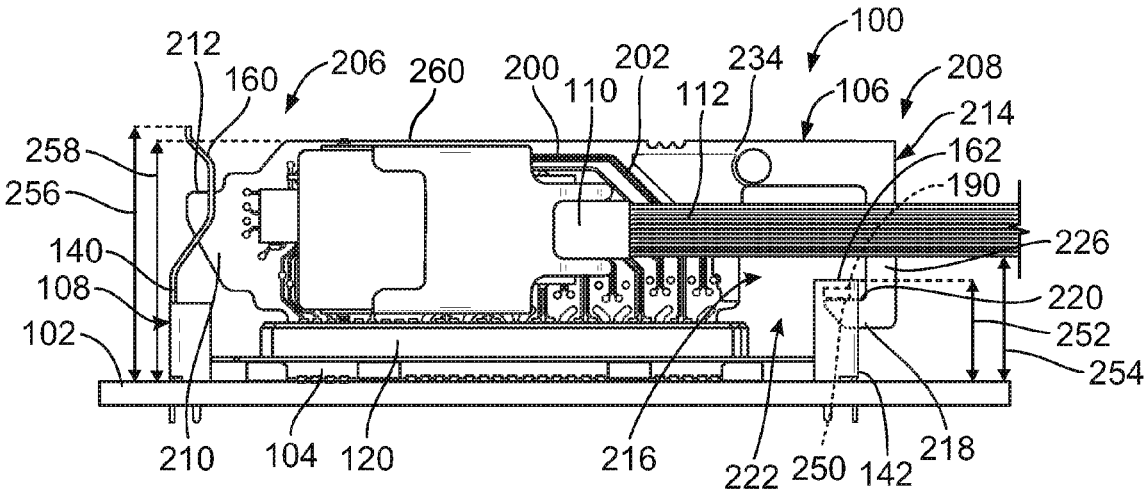
FIG. 7 is a side view of the card edge connector system showing the circuit card assembly in a fully mated position with the card edge connector.

FIG. 5 is a side view of the card edge connector system 100 showing the circuit card assembly 106 positioned for mating with the card edge connector 104. FIG. 6 is a side view of the card edge connector 100 showing the circuit card assembly 106 partially mated with the card edge connector 104. FIG. 7 is a side view of the card edge connector system 100 showing the circuit card assembly 106 in a fully mated position with the card edge connector 104.

During assembly, the circuit card 200 is plugged into the housing 120 of the card edge connector 104. The latch 108 is configured to secure the circuit card assembly 106 in the card edge connector 104. In an exemplary embodiment, the latch 108 is configured to guide mating of the circuit card assembly 106 with the card edge connector 104. In an exemplary embodiment, the circuit card assembly 106 is coupled to the card edge connector 104 by pivoting the circuit card assembly 106 into the card edge connector 104. The latch 108 defines a pivot point 250, about which the circuit card assembly 106 is pivoted during mating with the card edge connector 104. Initially, the circuit card 200 is positioned at an angle with respect to the card edge connector 104. The hook portion 214 is aligned with the latch hook 162 such that the hook end 218 engages the latch hook 162. The latch hook 162 defines the pivot point 250. The hook end 218 is loaded into the opening 180 (shown in FIG. 2) such that the hook portion 214 is captured by the second arm 142. The upper surface 220 of the hook end 218 engages the upper wall 182, and the pivot point 250 defined at the intersection between the upper wall 182 and the upper surface 220. The first end 206 of the circuit card 200 is rotated towards the first arm 140, which allows the plug edge 204 to be loaded into the slot 128 (shown in FIG. 2) of the housing 120. Rotating the circuit card 200 into the housing 120 reduces the insertion force required to insert the circuit card 200 into the housing 120. For example, at any given time, only a portion of the plug edge 204 and conductors 202 are being pressed into the slot 128 to engage the contacts 126 (shown in FIG. 2).

As the circuit card 200 is loaded into the housing 120, the tab 210 at the first end 206 eventually engages the first arm 140. The tab 210 is guided into the opening 164 (shown in FIG. 2) of the spring latch 160 by the dovetail 176 (shown in FIG. 2). The spring latch 160 may be deflected during loading of the circuit card 200 into the card edge connector 104. In the final mated position (shown in FIG. 7) the tab 210 is located in the opening 164 and engages the spring latch 160. The spring latch 160 holds the tab 210 and thereby secures the circuit card 200 in the card edge connector 104. In an exemplary embodiment, the upper wall 166 (shown in FIG. 2) engages the upper surface 212 of the tab 210. The spring latch 160 resists outward movement of the first end 206. In an exemplary embodiment, the side walls 168, 170 (shown in FIG. 2) engage the first side 234 and/or the second side 236, respectively, to hold the side-to-side position of the circuit card 200 with respect to the latch 108. The spring latch 160 may be moved to the released position by pulling the spring latch 160 away from the circuit card 200 until the tab 210 has clearance to be moved away from the latch 108.

In the final position, the latch hook 162 hooks around the upper surface 220 to hold the hook end 218 with respect to the latch 108 and the card edge connector 104. The latch hook 162 engages the second end 208 of the circuit card 200 to hold the circuit card 200 in the card edge connector 104.

When initially positioned, the latch hook 162 is received in the receiving space 216. The outer arm 226 of the hook portion 214 is positioned outside of the latch hook 162. The hook portion 214 hooks around the latch hook 162. The hook end 218 is received in the opening 180 (shown in FIG. 2) from outside the second arm 142. As the circuit card 200 is loaded into the card edge connector 104, the hook end 218 may be plugged further into the opening 180. The outer arm 226 is moved closer to the outer surface of the latch hook 162. In the final position, the outer arm 226 is positioned proximate to the outer surface of the latch hook 162. The tab 190 (shown in phantom in FIG. 7) engages the upper surface 220 of the hook end 218. The tab 190 is biased against the hook end 218 forcing the circuit card 200 into the housing 120.

In an exemplary embodiment, the latch 108 has a low profile allowing the optical fiber 112 to pass over the second arm 142 of the latch 108. The second arm 142 has a height 252 measured from the main circuit board 102 that is less than a height 254 of the optical fiber 112. As such, the optical fiber 112 is allowed to be routed from the optical connector 110 along a straight path beyond the second end 208 of the circuit card 200. The optical fiber 112 does not have to bend out of plane (e.g., away from the first side 234 of the circuit card 200) to pass the latch 108. Having the optical fibers 112 straight as opposed to curved or bent, allows for better optical performance and decreases the risk of damage to the optical fiber 112. In an exemplary embodiment, the first arm 140 has a height 256 measured from the main circuit board 102 that is taller than a height 258 of an outer edge 260 of the circuit card 200. Having the end of the first arm 140 above the circuit card 200 allows easy access to the spring latch 160 for releasing the spring latch 160 to the released position to remove the circuit card assembly 106 from the card edge connector 104.

Figure 8:
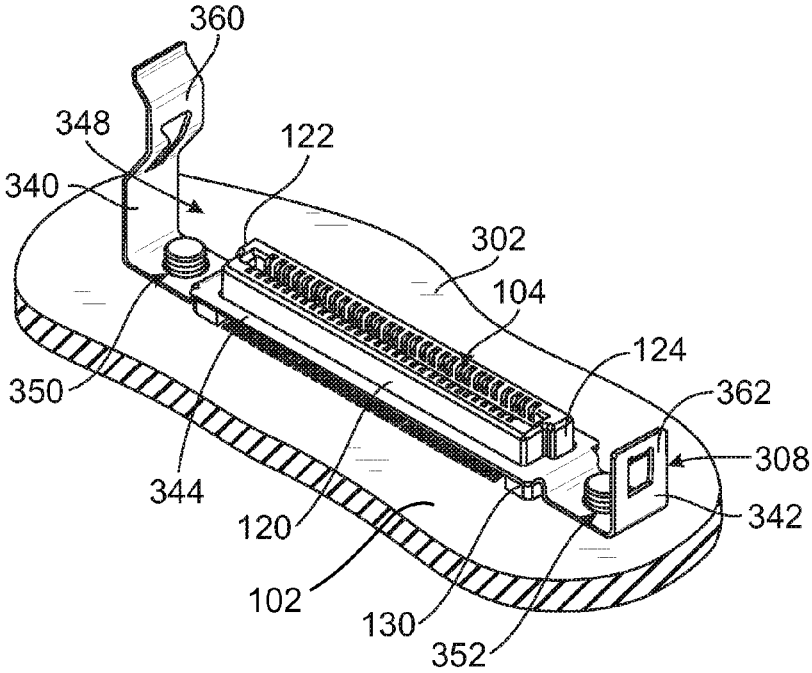
FIG. 8 is an isometric view of a latch used to secure a circuit card assembly to a card edge connector.

FIG. 8 is an isometric view of a latch 308 configured to secure the circuit card assembly 106 (shown in FIG. 1) to the card edge connector 104. The latch 308 differs from the latch 108 (shown in FIG. 1). The latch 308 is secured to the main circuit board 102 in a different manner. The latch 308 operates in a similar manner as the latch 108.

The latch 308 includes first and second arms 340, 342 disposed on the opposite ends 122, 124 of the housing 120 of the card edge connector 104. The first arm 340 is configured to secure one end of the circuit card assembly 106, while the second arm 342 is configured to secure an opposite end of the circuit card assembly 106.

The latch 308 includes a base 344 extending between the first and second arms 340, 342. In an exemplary embodiment, the base 344 extends over and engages the base 130 of the housing 120. When the latch 308 is mounted to the main circuit board 102, the base 344 holds the housing 120 against the main circuit board 302. A reception space 348 is defined between the first arm 340 and the second arm 342. The reception space 348 receives the circuit card assembly 106.

The first and second arms 340, 342 include mounting elements 350, 352, respectively. The mounting elements 350, 352 are used to mechanically and/or electrically connect the latch 308 to the main circuit board 102. In the illustrated embodiment, the mounting elements 350, 352 are fasteners extending through the main circuit board 102 into fastener openings in the base 344. The base 344 at the mounting elements 350, 352 is seated on the surface of the main circuit board 102 so that the fasteners may pull the latch 308 tight against the main circuit board 102. The fasteners may be screwed in from the top or the screws may be threaded into the main circuit board 102.

The first arm 340 includes a spring latch 360 that defines a securing element of the first arm 340. The spring latch 360 is configured to secure the circuit card assembly 106 to the card edge connector 104. The second arm 342 includes a latch hook 362 that defines a securing element of the second arm 342. The latch hook 362 is configured to secure the circuit card assembly 106 to the card edge connector 104. The spring latch 360 and the latch hook 362 may be similar to the spring latch 160 and the latch hook 162 (shown in FIG. 2), include similar features and secure the circuit card assembly 106 in a similar manner.

Figure 9:
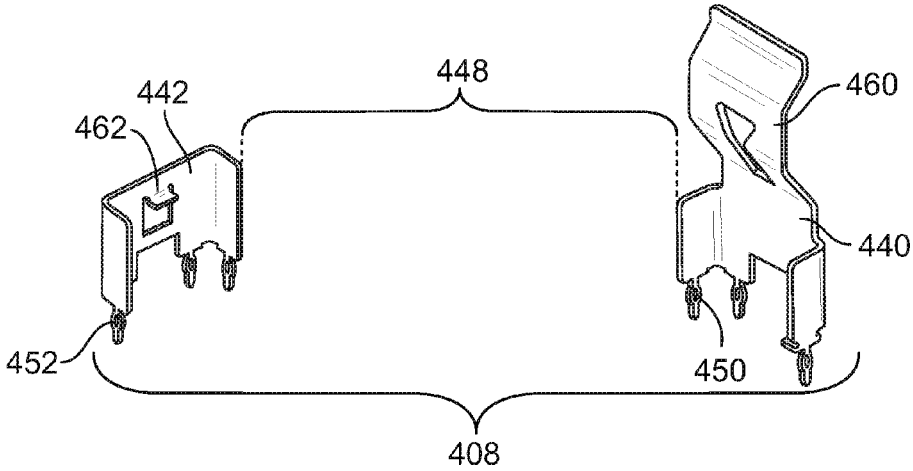
FIG. 9 illustrates a latch used to secure a circuit card assembly to a card edge connector.

FIG. 9 illustrates a latch 408 used to secure the circuit card assembly 106 (shown in FIG. 1) to the card edge connector 104 (shown in FIG. 1). The latch 408 differs from the latch 108 (shown in FIG. 1). The latch 408 includes discrete pieces that are independently mounted to the main circuit board 102 rather than a single piece that is mounted over the card edge connector 104. The latch 408 operates in a similar manner as the latch 108.

The latch 408 includes first and second arms 440, 442 configured to be disposed at opposite ends of the card edge connector 104. The first arm 440 is configured to secure one end of the circuit card assembly 106, while the second arm 442 is configured to secure an opposite end of the circuit card assembly 106. The first and second arms 440, 442 are separate from one another. The first and second arms 440, 442 may be separately mounted to the main circuit board 102. A reception space 448 is defined between the first arm 440 and the second arm 442. The reception space 448 may have any width to accommodate different sized card edge connectors 104. For example, by mounting the first arm 440 further apart from the second arm 442, the reception space 448 may be larger to accommodate larger card edge connectors 104. The first and second arms 440, 442 are not physically linked by a base or other component extending therebetween.

The first and second arms 440, 442 include mounting elements 450, 452, respectively. The mounting elements 450, 452 are configured to mechanically and/or electrically connect the latch 408 to the main circuit board 102. In the illustrated embodiment, the mounting elements 450, 452 are compliant pins configured to be mounted to the main circuit board 102.

The first arm 440 includes a spring latch 460 that defines a securing element of the first arm 440. The spring latch 460 is configured to secure the circuit card assembly 106 to the card edge connector 104. The second arm 442 includes a latch hook 462 that defines a securing element of the second arm 442. The latch hook 462 is configured to secure the circuit card assembly 106 to the card edge connector 104. The spring latch 460 and the latch hook 462 may be similar to the spring latch 160 and the latch hook 162 (shown in FIG. 2), include similar features and secure the circuit card assembly 106 in a similar manner.

Figure 10:
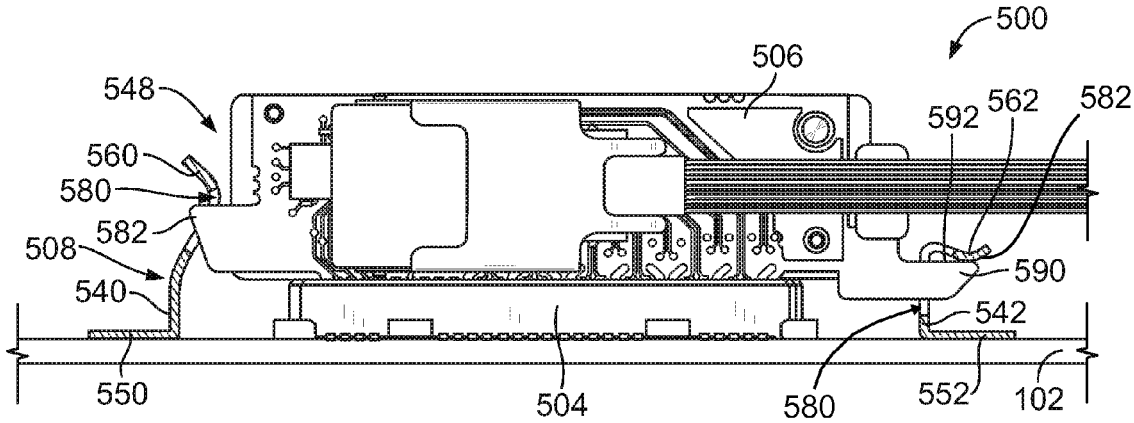
FIG. 10 is a side view of a card edge connector system showing a latch used to secure a circuit card assembly to a card edge connector.

FIG. 10 is a side view of a card edge connector system 500. The card edge connector system 500 includes a card edge connector 504, which is configured to be mounted to the main circuit board 102, a circuit card assembly 506 and a latch 508. The card edge connector 504 may be similar to the card edge connector 104 (shown in FIG. 1). The circuit card assembly 506 may be similar to the circuit card assembly 106 (shown in FIG. 1). In the illustrated embodiment, the circuit card assembly 506 includes a tab extending from the second end rather than a hook as with the circuit card assembly 106. The latch 508 is similar to the latch 108 (shown in FIG. 1). The latch receives the circuit card assembly 506 in a different manner than how the latch 108 receives the circuit card assembly 106. The latch 508 is mounted to the main circuit board 102 in a different manner. The latch 508 is shaped differently than the latch 108. The latch 508 operates in a similar manner as the latch 108.

The latch 508 includes first and second arms 540, 542 configured to be disposed at opposite ends of the card edge connector 104. The first arm 540 is configured to secure one end of the circuit card assembly 106, while the second arm 542 is configured to secure an opposite end of the circuit card assembly 106. The first and second arms 540, 542 are separate from one another, however the first and second arms 540, 542 may be joined by a base similar to the base 144 (shown in FIG. 2) in an alternative embodiment. The first and second arms 540, 542 are separately mounted to the main circuit board 102. In an exemplary embodiment, the first and second arms 540, 542 may be surface mounted to the main circuit board 102, such as by soldering the first and second arms 540, 542 to the upper surface of the main circuit board 102. A reception space 548 is defined between the first arm 540 and the second arm 542.

The first and second arms 540, 542 include mounting elements 550, 552, respectively. The mounting elements 550, 552 are configured to mechanically and/or electrically connect the latch 508 to the main circuit board 102. In the illustrated embodiment, the mounting elements 550, 552 are solder tabs that are bent to be parallel to the upper surface of the main circuit board 102 for surface mounting to the main circuit board 102.

The first arm 540 includes a spring latch 560 that defines a securing element of the first arm 540. The spring latch 560 is configured to secure the circuit card assembly 506 to the card edge connector 504. The spring latch 560 operates in a similar manner as the spring latch 160 (shown in FIG. 2). The second arm 542 includes a latch hook 562 that defines a securing element of the second arm 542. The latch hook 562 is configured to secure the circuit card assembly 506 to the card edge connector 504. In the illustrated embodiment, the latch hook 562 is shaped differently than the latch hook 162 (shown in FIG. 2). The latch hook 562 includes an opening 580 and a tab 582 extending outward from a top of the latch hook 562.

The circuit card assembly 506 includes a tab 590 extending from the second end of the circuit card thereof. The tab 590 defines a hook portion that is configured to be hooked under the latch hook 562. The tab 590 includes an upper surface 592 that engages the tab 582 of the latch hook 562. The tab 590 is received in the opening 580 during mating. In an exemplary embodiment, the circuit card assembly 506 may be loaded into the latch 508 at an angle in a similar manner as the circuit card assembly 106 is loaded into the latch 108. The latch hook 562 defines a pivot point about which the circuit card assembly 506 may be loaded into the card edge connector 504. The latch hook 562 defines a spring latch. When mated, the upper surface 592 of the tab 590 is captured under the tab 582 of the latch hook 562.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A latch for securing a circuit card assembly to a circuit board mounted card edge connector, the latch comprising:

first and second arms disposed on opposite ends of the card edge connector, the first and second arms defining a reception space that receives the circuit card assembly;

a base extending between the first and second arms, the base being configured to engage the card edge connector;

the first arm having a deflectable spring latch movable between a released position and a latched position, the circuit card assembly being secured by the spring latch in the latched position; and the second arm having a latch hook configured to hook around and engage a portion of the circuit card assembly during mating of the circuit card assembly and the card edge connector, the latch hook defining a pivot point for pivoting the circuit card assembly into the card edge connector during mating of the circuit card assembly and the card edge connector.

2. The latch of claim 1, wherein the latch is configured to be mounted to the circuit board separate from the card edge connector.

3. The latch of claim 1, wherein the spring latch is deflectable away from the second arm.

4. The latch of claim 1, wherein the spring latch includes an opening having a retention slot defined between side walls, the side walls being configured to engage opposite sides of a circuit card of the circuit card assembly, the opening having a dovetail leading into the retention slot to guide the circuit card into the retention slot, the spring latch restricting movement in multiple directions including an unmating direction and side-to-side.

5. The latch of claim 1, wherein the latch hook includes an opening configured to receive a hook portion of a circuit card of the circuit assembly, the opening capturing the hook portion of the circuit card.

6. A card edge connector system comprising:

a card edge connector having a housing, a plurality of contacts held by the housing and a slot in the housing configured to receive a circuit card assembly therein for mating with the contacts, the card edge connector being configured to be coupled to a main circuit board; and a latch cooperating with the card edge connector to secure the circuit card assembly in the card edge connector, the latch being configured to be coupled to the main circuit board, the latch comprising a first arm and a second arm, the first and second arms being physically separate from one another and independently mountable to the main circuit board, a reception space being defined between the first and second arms, a width of the reception space being adjustable to accommodate different sized card edge connectors, the first arm having a deflectable spring latch configured to engage a portion of the circuit card assembly during mating of the circuit card assembly and the card edge connector, the second arm having a latch hook configured to hook around and engage a portion of the circuit card assembly during mating of the circuit card assembly and the card edge connector, the latch hook defining a pivot point for pivoting the circuit card assembly into the card edge connector during mating of the circuit card assembly and the card edge connector.

7. The card edge connector system of claim 6, wherein the latch is configured to be mounted to the circuit board separate from the card edge connector.

8. The card edge connector system of claim 6, wherein the spring latch is deflectable away from the second arm.

9. The card edge connector system of claim 6, wherein the spring latch includes an opening defined by an upper wall, the upper wall being configured to engage the circuit card assembly in the latched position.

10. The card edge connector system of claim 6, wherein spring latch includes an opening having a retention slot defined between side walls, the side walls being configured to engage opposite sides of a circuit card of the circuit card assembly, the opening having a dovetail leading into the retention slot to guide the circuit card into the retention slot.

11. The card edge connector system of claim 6, wherein the latch hook includes an opening configured to receive a hook portion of a circuit card of the circuit assembly, the opening capturing the hook portion of the circuit card.

12. The card edge connector system of claim 6, further comprising a circuit card assembly having a circuit card having a plurality of conductors, the circuit card having a plug edge, the circuit card having a first end and a second end opposite the first end, the plug edge being plugged into the slot in the housing to connect the conductors with corresponding contacts, the first arm engaging the circuit card, the second arm engaging the circuit card.

13. The card edge connector system of claim 6, wherein the latch hook includes an interior facing the card edge connector and an exterior facing away from the card edge connector, the latch hook includes an opening configured to receive a hook portion of a circuit card of the circuit assembly from the exterior, wherein the hook portion wraps around the latch hook, the opening capturing the hook portion of the circuit card.

14. A latch for securing a circuit card assembly to a circuit board mounted card edge connector, the latch comprising:

first and second arms disposed on opposite ends of the card edge connector, the first and second arms defining a reception space that receives the circuit card assembly;

the first arm having a deflectable spring latch movable between a released position and a latched position, the circuit card assembly being secured by the spring latch in the latched position, wherein the spring latch includes an opening defined by an upper wall, the upper wall being configured to engage the circuit card assembly in the latched position; and the second arm having a latch hook configured to hook around and engage a portion of the circuit card assembly during mating of the circuit card assembly and the card edge connector, the latch hook defining a pivot point for pivoting the circuit card assembly into the card edge connector during mating of the circuit card assembly and the card edge connector.

15. The latch of claim 14, wherein the latch is separate from the card edge connector and is configured to be mounted to the circuit board separate from and adjacent to the card edge connector.

16. The latch of claim 14, wherein the latch includes a base extending between the first and second arms, the base engaging the card edge connector.

17. The latch of claim 14, wherein the spring latch is deflectable away from the second arm.

18. The latch of claim 14, wherein the opening in the spring latch includes a retention slot defined between side walls, the side walls being configured to engage opposite sides of a circuit card of the circuit card assembly, the opening having a dovetail leading into the retention slot to guide the circuit card into the retention slot, the spring latch restricting movement of the circuit card assembly in multiple directions including an unmating direction and side-to-side.

19. The latch of claim 14, wherein the latch hook includes an opening configured to receive a hook portion of a circuit card of the circuit assembly, the opening capturing the hook portion of the circuit card.

* * * * *